US007510181B2

(12) United States Patent
Kozaki

(10) Patent No.: US 7,510,181 B2
(45) Date of Patent: Mar. 31, 2009

(54) SHEET-SUPPLY CASSETTE, AND IMAGE RECORDING APPARATUS INCLUDING SHEET-SUPPLY CASSETTE

(75) Inventor: Daisuke Kozaki, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 497 days.

(21) Appl. No.: 11/209,667

(22) Filed: Aug. 24, 2005

(65) Prior Publication Data

US 2006/0071404 A1 Apr. 6, 2006

(30) Foreign Application Priority Data

Aug. 24, 2004 (JP) ..... 2004-244307

(51) Int. Cl.
*B65H 1/00* (2006.01)

(52) U.S. Cl. ..... 271/171; 271/145; 399/393; 399/377

(58) Field of Classification Search ..... 271/145, 271/171; 399/393, 377
See application file for complete search history.

(56) References Cited

U.S. PATENT DOCUMENTS

| | | | | |
|---|---|---|---|---|
| 5,292,117 | A * | 3/1994 | Takagi et al. | 271/234 |
| 5,313,257 | A * | 5/1994 | Kashima et al. | 399/393 |
| 5,537,195 | A * | 7/1996 | Sagara et al. | 399/381 |
| 5,564,690 | A * | 10/1996 | Oshida | 271/157 |
| 6,918,483 | B2 * | 7/2005 | Washington et al. | 194/350 |
| 6,984,084 | B2 * | 1/2006 | Ng et al. | 400/624 |
| 7,097,172 | B2 * | 8/2006 | Chang | 271/171 |
| 7,111,841 | B2 * | 9/2006 | Jacobs et al. | 281/171 |
| 7,198,266 | B2 * | 4/2007 | Takahashi et al. | 271/171 |
| 7,258,338 | B2 * | 8/2007 | Lee et al. | 271/171 |
| 7,263,326 | B2 * | 8/2007 | Amagai | 399/393 |
| 2004/0169327 | A1 * | 9/2004 | Swayze et al. | 271/145 |
| 2004/0188922 | A1 * | 9/2004 | Takahashi et al. | 271/145 |

FOREIGN PATENT DOCUMENTS

| | | |
|---|---|---|
| JP | 9-110191 | 4/1997 |
| JP | 2002-154668 | 5/2002 |
| JP | 2002-173240 | 6/2002 |

* cited by examiner

*Primary Examiner*—Patrick H Mackey
*Assistant Examiner*—Prasad V Gokhale
(74) *Attorney, Agent, or Firm*—Banner & Witcoff, Ltd.

(57) ABSTRACT

A sheet-supply cassette including a main member which is open upward and which is adapted to store recording sheets that are stacked on each other; an auxiliary member which is open upward and which is adapted to support respective trailing end portions of the recording sheets as seen in a sheet-feed direction in which each of the recording sheets is fed, wherein the auxiliary member is attached to the main member such that the auxiliary member is movable relative to the main member, in each of opposite directions parallel to the sheet-feed direction, so that the auxiliary member is engaged with the main member at an arbitrary one of engagement positions; first engaging portions which are distant from each other in the sheet-feed direction; and an elastically deformable portion including, as an integral portion thereof, a second engaging portion which can engage an arbitrary one of the first engaging portions so as to define a corresponding one of the engagement positions. The elastically deformable portion including the second engaging portion is integrally formed with one of the main member and the auxiliary member, and the first engaging portions are provided in an other of the main member and the auxiliary member.

13 Claims, 16 Drawing Sheets

SHEET-SUPPLY CASSETTE, AND IMAGE RECORDING APPARATUS INCLUDING SHEET-SUPPLY CASSETTE

The present application is based on Japanese Patent Application No. 2004-244307 filed on Aug. 24, 2004, the contents of which are incorporated herein by reference.

BACKGROUND OF THE INVENTION

1. Field of the Invention

The present invention relates to a sheet-supply cassette, and an image recording apparatus, such as a printer, a copier, or a facsimile machine, that includes a sheet-supply cassette.

2. Discussion of Related Art

There has conventionally been known a sheet-supply cassette that is employed by an image recording apparatus such as a printer, a copier, or a facsimile machine and supplies, one by one, a plurality of cut recording sheets each as a recording medium, and there have been many proposals to provide such a sheet-supply cassette that is changeable or adjustable in size so as to accommodate various sorts of recording sheets having different lengths.

For example, Patent Document 1 (Japanese Patent Application Publication No. 2002-154668) discloses a sheet-supply cassette including a main member that is provided on the side of a sheet feeding device that feeds each recording sheet to a recording device; and a slidable member (i.e., an auxiliary member) that is attached to the main member such that the slidable member is extended from, and retracted into, the main member in a direction parallel to a sheet-feed direction in which each recording sheet is fed. The main member has a double-bottom structure including a bottom plate and an upper plate attached to the bottom plate. The slidable member also has a bottom plate that slidably fits in a space present between the bottom and upper plates of the main member. In a gap left between an upper surface of the bottom plate of the slidable member and the upper plate of the main case, there are provided two lock members that lock the sliding movement of the bottom plate of the slidable member. A pair of elongate holes each of which is elongate in the sheet-feed direction and has two waiting holes at lengthwise opposite ends thereof are formed with an appropriate depth in an upper surface of the bottom plate of the main member. Each of the lock members includes an operable portion that projects upward through a rectangular opening formed through the thickness of the upper plate, and a lower projection that is fitable in either one of the two waiting holes of a corresponding one of the elongate holes so as to fix the sliding movement of the slidable member.

In addition, Patent Document 2 (Japanese Patent Application Publication No. 9-110191) discloses a sheet-supply cassette including a main member that has a box-like shape and opens upward, and a slidable member that is slidable relative to the main member so as to be extended from, and retracted into, the main member. The main member has, on a lower surface of a bottom plate thereof, a plurality of engaging bosses that are distant from each other in a sheet-feed direction in which each recording sheet is fed. The slidable member has, on an upper surface of a bottom plate thereof a lock lever whose intermediate portion is connected to the upper surface such that the lock lever is pivotable on a horizontal plane. In addition, the slidable member includes a front wall having a recess in which a horizontal support shaft is provided such that the support shaft supports an operable member that is operable to unlock the lock lever from one of the engaging bosses. A thickened portion as a lower end portion of the operable member is held in contact with an inclined surface formed in one end portion of the lock lever. Thus, when the lower end portion of the operable member is rotated toward the front wall of the slidable member, the lock lever is rotated on the horizontal plane so as to be unlocked from one of the engaging bosses.

However, in each of the sheet-supply cassettes disclosed by the above-indicated two patent documents, many components are needed to lock the sliding movement of the slidable member and, since it is cumbersome to assemble those components, a production cost of the each cassette is inevitably increased.

In addition, the main member disclosed by Patent Document 1 has the double-bottom structure and therefore a step is formed between the upper plate of the main member and the bottom plate of the slidable member when the slidable member is extended. Also, in the sheet-supply cassette disclosed by Patent Document 2, a step is formed between the upper plate of the main member and the bottom plate of the slidable member when the slidable member is extended because the slidable member overlies the main member. Thus, respective trailing-end portions of recording sheets stacked in the main member and the slidable member fall down, at the step, onto the bottom plate of the slidable member. Consequently the recording sheets are bent or wrinkled at the step. The degree of wrinkling increases in the direction toward the lowermost recording sheet. This leads to occurrence of jamming of recording sheets when they are fed to a recording device, or leads to lowering the quality of recording of images on recording sheets.

SUMMARY OF TEE INVENTION

It is therefore an object of the present invention to provide a sheet-supply cassette that is free of at least one of the above-indicated problems. It is another object of the present invention to provide a sheet-supply cassette that has a simple construction and is free of the problem of bending or wing of recording sheets stacked therein. It is another object of the present invention to provide an image recording apparatus employing the sheet-supply cassette.

According to a first aspect of the present invention, there is provided a sheet-supply cassette, comprising a main member which is open upward and which is adapted to store a plurality of recording sheets that are stacked on each other; an auxiliary member which is open upward and which is adapted to support respective trailing end portions of the recording sheets as seen in a sheet-feed direction in which each of the recording sheets is fed, wherein the auxiliary member is attached to the main member such that the auxiliary member is movable relative to the main member, in each of opposite directions parallel to the sheet-feed direction, so that the auxiliary member is engaged with the main member at an arbitrary one of a plurality of engagement positions; a plurality of first engaging portions which are distant from each other in the sheet-feed direction; and an elastically deformable portion including, as an integral portion thereof, a second engaging portion which can engage an arbitrary one of the first engaging portions so as to define a corresponding one of the engagement positions. The elastically deformable portion including the second engaging portion is integrally formed with one of the main member and the auxiliary member, and the first engaging portions are provided in an other of the main member and the auxiliary member.

In the sheet-supply cassette in accordance with the first aspect of the present invention, the elastically deformable portion includes, as an integral portion thereof, the second engaging portion which can engage an arbitrary one of the first engaging portions so as to define a corresponding one of the engagement positions where the auxiliary member engages the main member. Since the elastically deformable portion is used to cause the second engaging portion to selectively engage an arbitrary one of the first engaging portions, the total number of components can be reduced and additionally the elastically deformable portion need not be assembled. Thus, the present sheet-supply cassette can enjoy a simple construction and a low production cost.

According to a second aspect of the present invention, there is provided an image recording apparatus, comprising the sheet-supply cassette according to the first aspect of the present invention; a recording portion which records an image on said each recording sheet supplied thereto from the sheet-supply cassette; and a U-turn-path defining member which defines a U-turn path through which said each recording sheet is supplied from the sheet-supply cassette to the recording portion.

Since the image recording apparatus in accordance with the second aspect of the present invention employs the sheet-supply cassette in accordance with the first aspect of the present invention, the image recording apparatus can enjoy the same advantages as the above-described advantages of the sheet-supply cassette.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
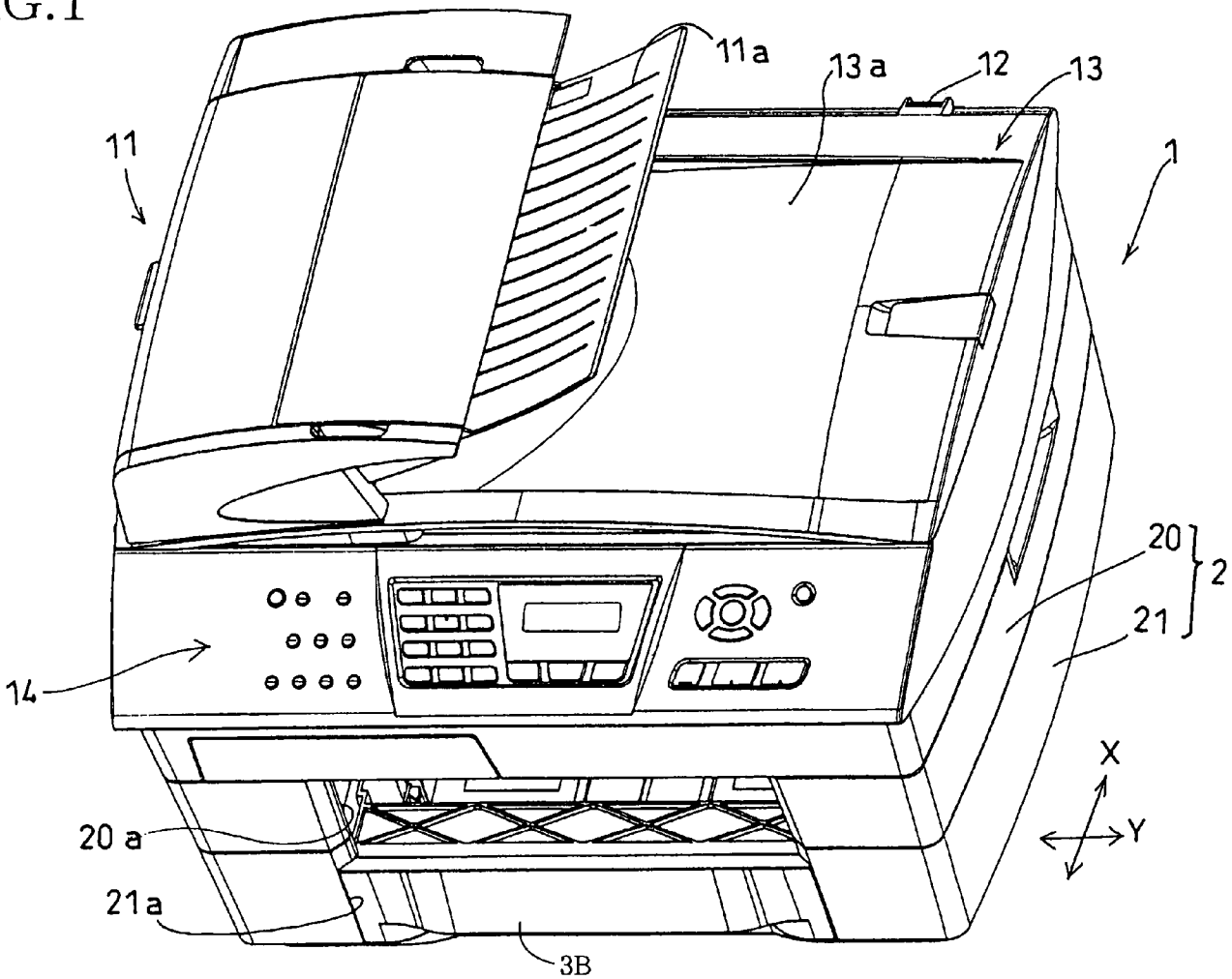
FIG. 1 is a perspective view of an image-recording apparatus as a first embodiment of the present invention.

Hereinafter, there will be described preferred embodiments of the present invention by reference to the drawings. FIG. 1 shows an image recording apparatus 1 to which the present invention is applied. The image recording apparatus 1 is a so-called "multi-function device (MFD)" that has a printer function, a copier function, a scanner function, and a facsimile-machine function. As shown in the figure, the image recording apparatus 1 includes a housing 2 that is formed of a synthetic resin and includes a first lower case 20 and a second lower case (i.e., a lowermost case) 21 that is connected to the bottom of the first lower case 20; an upper sheet-supply cassette 3A (FIGS. 2 and 3) that is insertable into an opening 20*a* provided in a front-side portion of the first lower case 20; and a lower sheet-supply cassette 3B that is insertable into an opening 21*a* provided in a front-side portion of the second lower case 21. FIG. 1 shows a state in which the lower sheet-supply cassette 3B is inserted in the housing 2 but the upper sheet-supply cassette SA is not inserted in the same 2. In the following description of each of the components, such as the housing 2, the first lower case 20, the second lower case 21, or the upper or lower sheet-supply cassette 3A, 3B, a portion, an end, or a side of the each component that is located nearer to the openings 20*a*, 21*a* will be referred to as a front portion, a front end, or a front side of the each component, and a portion, an end, or a side of the each component that is located opposite to the openings 20*a*, 21*a* will be referred to as a rear portion, a rear end, or a rear side of the each component.

In a top portion of the image recording apparatus 1, there are provided an image reading device, not shown, including an automatic original-sheet feeder 11 that automatically feeds an original sheet bearing an original image, so as to read the original image in a copier or facsimile-machine mode, and an operation panel 14 that is located in front of the image reading device and includes various sorts of operation keys and a liquid-crystal display (FIG. 1). The image reading device additionally includes an original-sheet support glass plate, not shown, that supports, on an upper surface thereof an original sheet and can be covered by an original-sheet cover member 18 whose rear end is connected via hinges 12 to a rear end of the image reading device such that the cover member 13 is pivotable upward and downward about the hinges 12. When a user opens the cover member 13 by pivoting the same 13 upward, and places an original sheet on the upper surface of the support glass plate, an image scanner (e.g., a contact image sensor (CIS)) that is provided below the support glass plate is reciprocated in a main scanning direction, i.e., a Y-axis direction in FIG. 1, so as to read an original image borne by the original sheet. The Y-axis direction is perpendicular to the drawing sheet of FIG. 2. Meanwhile, an original sheet that is placed on an original-sheet supply plate 11*a* of the automatic original-sheet feeder 11 is fed downward so that an original image borne by the original sheet is read by the image scanner in an original-image reading area, not shown, that is provided in a left-hand end portion of the support glass plate in FIG. 1, and then the original sheet is discharged onto an original-sheet discharge plate 13*a*, i.e., an upper wall of the cover member 13.

Figure 2:
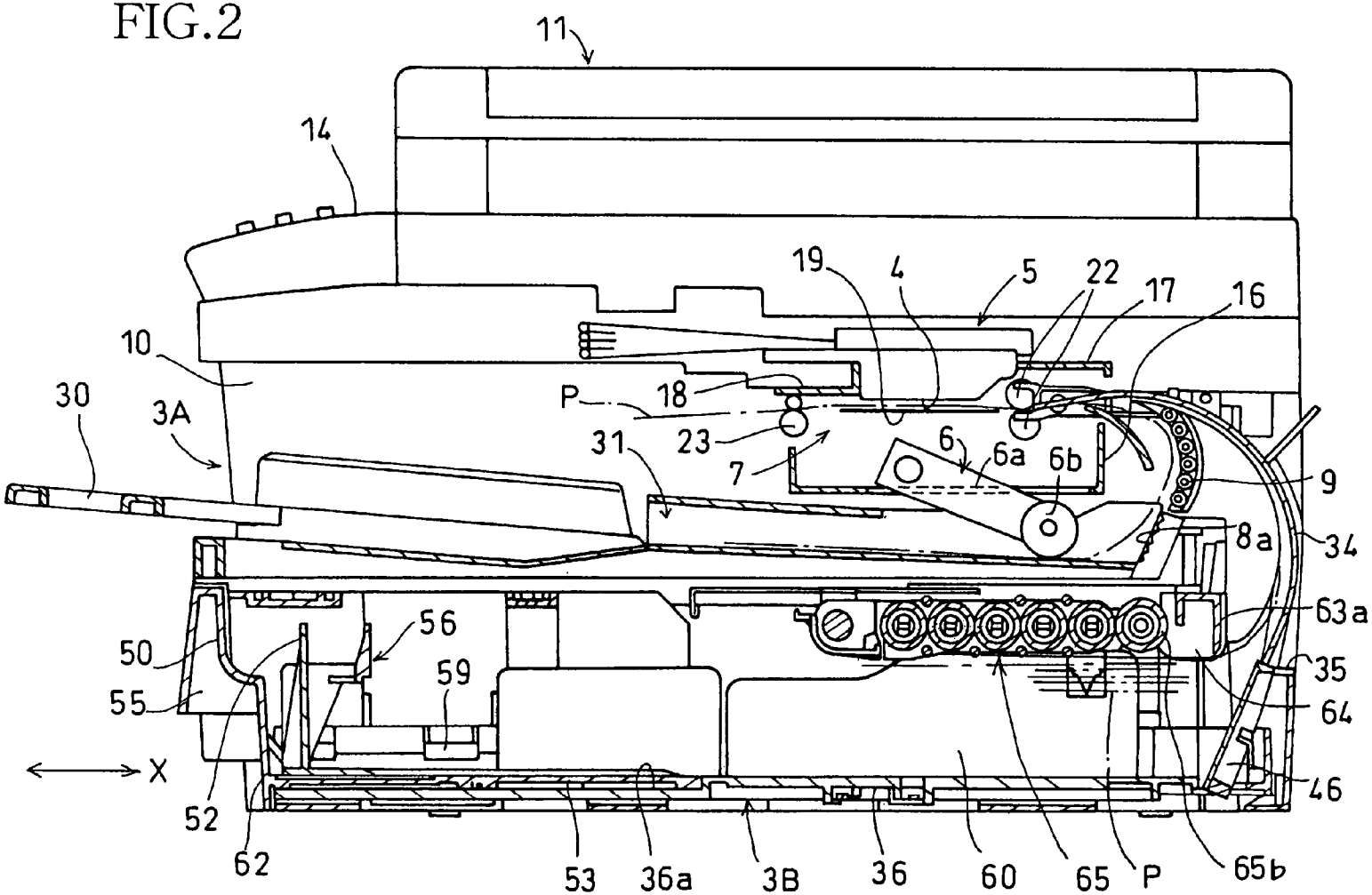
FIG. 2 is a cross-section view of two sheet-supply cassettes of the image recording apparatus.
Figure 3:
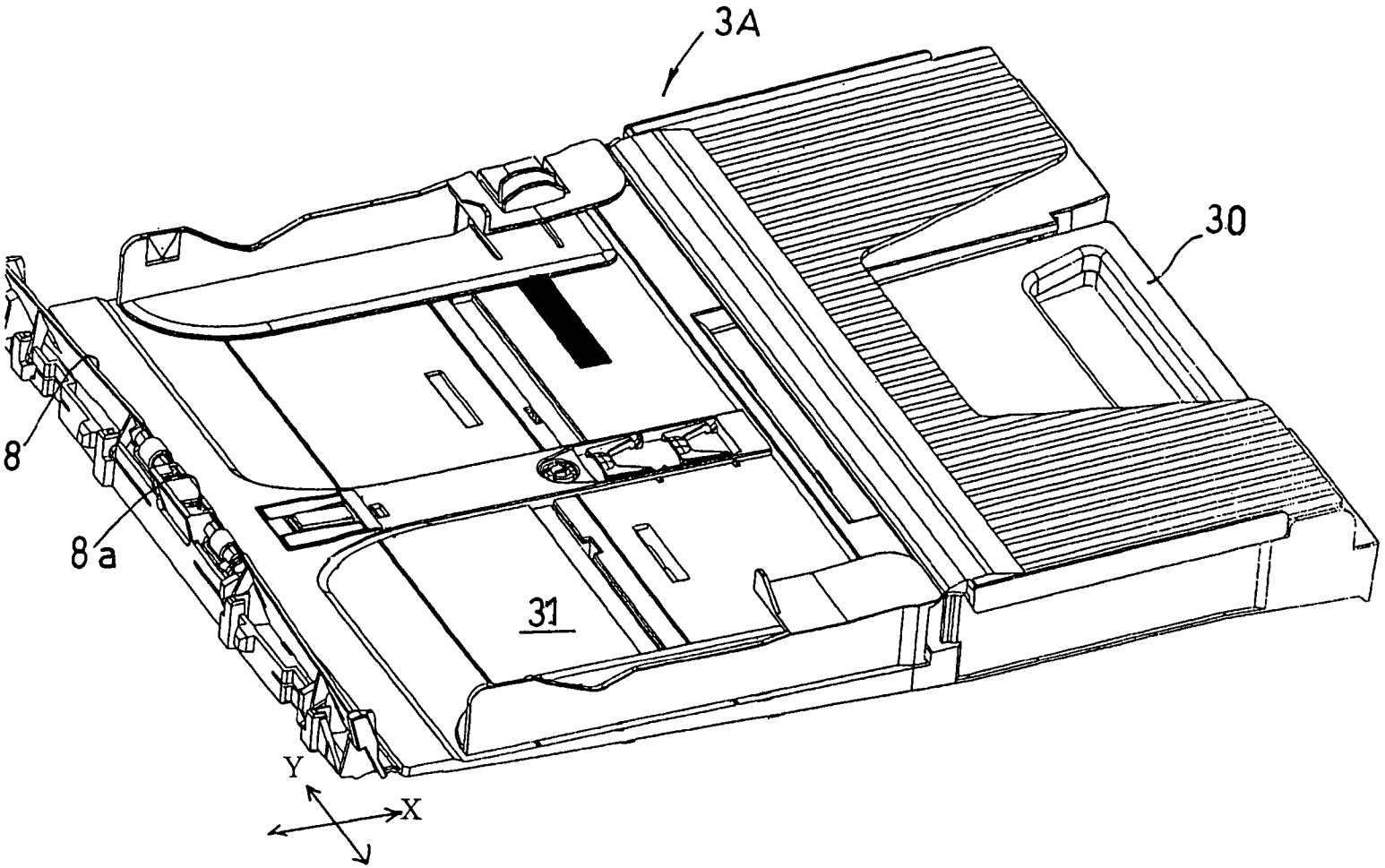
FIG. 3 is a perspective view of an upper one of the two sheet-supply cassettes.

Under the operation panel 14 and the image reading device, there are provided a recording portion 7 and a sheet discharging portion 10, as shown in FIG. 2.

As shown in FIG. 2, the recording portion 7 includes two elongate plate-like guide members 17, 18 that are respectively supported by two side walls of a main frame 16 formed of, e.g., a metallic plate and that extend in the Y-axis direction (i.e., the main scanning direction); a carriage 5 that supports a recording head 4 and bridges the two guide members 17, 18 such that the carriage 5 is slidable and reciprocateable on the same 17, 18; a timing belt, not shown, that is provided on an upper surface of the guide member 18, located on a downstream side in a sheet-feed direction, such that the timing belt extends parallel to the guide member 18, and that is driven to reciprocate the carriage 5; a carriage (CR) motor, not shown, that drives the timing belt; a plate-like platen 19 that is provided below a lower surface of the recording head 4 and supports a recording sheet, P, being fed; and a belt-like encoder strip, not shown, that extends in the Y-axis direction and detects a current position of the carriage 5 in the Y-axis direction. The sheet-feed direction is a direction in which the recording sheet P is fed. The encoder strip has a detection surface in which a plurality of slits are formed at a regular interval in the Y-axis direction, and is provided such that the detection surface is vertical.

Two register rollers 22 are provided on an upstream side of the platen 19, and cooperate with each other to pinch and feed the recording sheet P to a space below the lower surface of the recording head 4. On a downstream side of the platen 19, there are provided a spur roller that contacts an upper surface (i.e., a recording surface) of the recording sheet P, and a discharge roller 23 that contacts a lower surface (i.e., a non-recording surface) of the sheet P. The discharging portion 10 discharges the recording sheet P such that the image-recorded surface of the sheet P, recorded by the recording portion 7, faces upward. The discharging portion 10 is provided above the upper sheet-supply cassette 3A, such that a sheet-discharge opening communicating with the discharging portion 10 is provided in the front wall of the housing 2, more specifically described, is located above the opening 20*a*.

Next, there will be described respective constructions of the two sheet-supply cassettes 3A, 3B. First, the upper sheet-supply cassette 3A that is insertable in the first lower case 20 is described by reference to FIGS. 2 and 3. The upper sheet-supply cassette 3A includes an accommodating portion (i.e., a main portion) 31 that can accommodate a plurality of cut recording sheets P each as a recording medium, such as A4-size sheets, legal-size sheets, letter-size sheets, or post-card-size sheets, such that the sheets P are stacked on each other and respective short sizes of the sheets P extend in a direction (i.e., the direction perpendicular to the drawing sheet of FIG. 2, the main scanning direction, or the Y-axis direction) perpendicular to the sheet-feed direction (i.e., a sub-scanning direction or an X-axis direction). The upper sheet-supply cassette 3A additionally includes, in a front end portion thereof (located nearer to the opening 20*a*), an auxiliary support member 30 that supports respective rear end portions of long cut sheets P, such as legal-size sheets, and is movable relative to the accommodating portion 31 in the X-axis direction. FIG. 2 shows a state in which the auxiliary support member 30 is held at an extended position thereof where a portion of the support member 30 projects out of the housing 2. On the other hand, in the case where short cut sheets P, such as A4-size sheets, that can be fully accommodated by the accommodating portion 31, i.e., do not project out of the first lower case 20 through the opening 20*a* are used, the support member 30 can be retracted into the accommodating portion 81.

In the state in which the auxiliary support member 30 is retracted into the accommodating portion 31 of the upper sheet-supply cassette 3A, a length of the upper cassette 3A in the X-axis direction is substantially equal to that of the image reading device or the operation panel 14 in the Y-axis direction. In this state, therefore, the image recording apparatus 1 has a substantially square shape in its plane view, and also has a generally rectangular parallelepiped shape. Thus, when the apparatus 1 is shipped as a final product from a factory, the apparatus 1 can be easily packed, and a size of a package used to pack the same 1 can be reduced.

In addition, the upper sheet-supply cassette 3A has, in a rear end portion thereof (i.e., a right-hand end portion in FIG. 2, or a left-hand end portion in FIG. 3), an inclined sheet-separate plate 8 that separates each one cut sheet P from the other cut sheets P. An arm 6*a* is pivotally connected, at an upper end portion thereof; to the housing 2 such that the arm 6*a* is pivotable upward and downward, and a sheet-supply roller 6*b* is supported by a lower end portion of the arm 6*a*. The arm 6*a* and the roller 6*b* cooperate with each other to provide a sheet-supply drive portion (i.e., a sheet feeder) 6 that cooperates with the inclined sheet-separate plate 8 to separate and feed, one by one, the cut sheets P stacked on each other in the upper sheet-supply cassette 3A. The separated sheet P is fed via a first U-turn path (i.e., a first sheet-convey path) 9 that is initially oriented obliquely upward, and then backward to the recording portion 7 provided at a position higher than the upper sheet-supply cassette 3A. The inclined sheet-separate plate 8 has a convexly curved shape in its plan view in which a middle portion of the plate 8 in a widthwise direction of the sheet P, i.e., the Y-axis direction, swells toward the accommodating portion 31 and opposite end portions of the plate 8 in the Y-axis direction do not swell. On the middle portion of the sheet-separate plate 8, there is provided a serrate elastic sheet-separate pad 8*a* that engages a leading end of each cut sheet P to promote separation of the each cut sheet P from the other cut sheets P.

As shown in FIGS. 2 and 4 through 8, the lower sheet-supply cassette 3B includes a main portion 32 that opens upward and can accommodate a plurality of cut recording sheets P such that the sheets P are stacked on each other; and an auxiliary portion 33 that opens upward, supports respective rear end portions of the sheets P in the sheet-feed direction, i.e., the X-axis direction, and is connected to the main portion 52 such that the auxiliary portion 33 is movable frontward and rearward relative to the main portion 32. Each of the main portion 32 and the auxiliary portion 33 is formed by injection molding of a synthetic resin. In the present embodiment, the auxiliary portion 33 is located nearer to the opening 21*a* provided in the front wall of the second lower case 21. The second lower case 21 that opens upward is connected to the bottom of the first lower case 20, such that the second lower case 21 is joined with, e.g., screws, not shown, to the fist lower case 20. A recess 35 is formed in the respective rear end walls of the first and second lower cases 20, 21, and a second U-turn path (i.e., a second sheet-convey path) 34 that is integral with the first U-turn path 9 is detachably attached to the recess 35.

Figure 8:
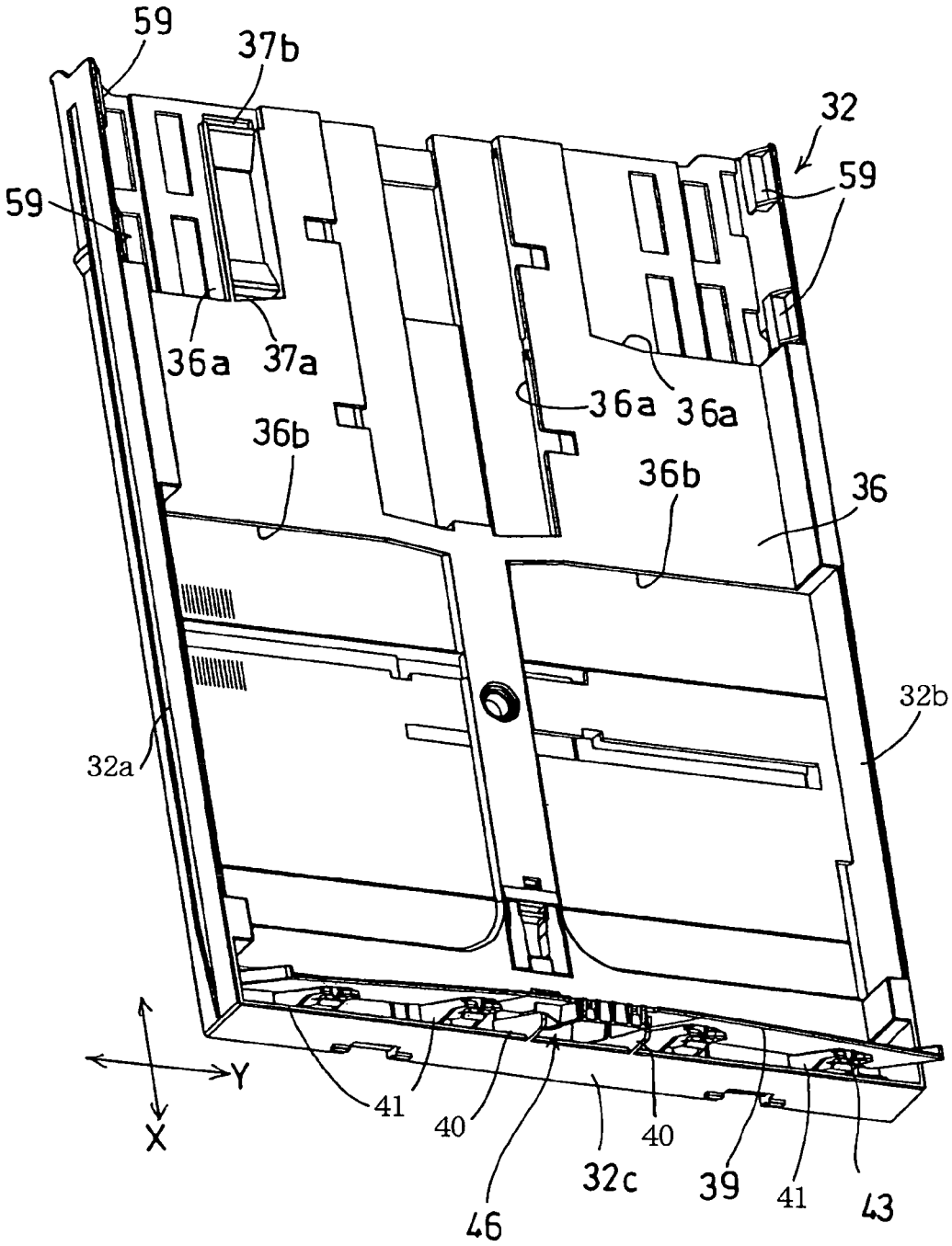
FIG. 8 is a perspective view of a main portion of the lower sheet-supply cassette in a state in which an auxiliary portion of the cassette and two sheet-side-end guide members are removed.

As shown in FIG. 8, the main portion 32 of the lower cassette 3B includes a bottom plate 36, two side plates 32*a*, 32*b*, and a rear plate 32*c*. The bottom plate 36 has, in a front end portion thereof, a plurality of front stepped portions 36*a*, and one of the front stepped portions 36*a* has, at a position deviated by an appropriate distance in one direction from the middle portion of each cut sheet P in the widthwise direction thereof (i.e., the Y-axis direction) perpendicular to the sheet-feed direction, a plurality of engaging grooves 37*a*, 37*b* as a plurality of first engaging portions that respectively define a plurality of engagement positions (described in detail later) of the auxiliary portion 33 that correspond to different lengths of a plurality of sorts of cut sheets P in the sheet-feed direction. The grooves 37*a*, 37*b* are distant from each other by an appropriate distance in the X-axis direction.

Figure 7:
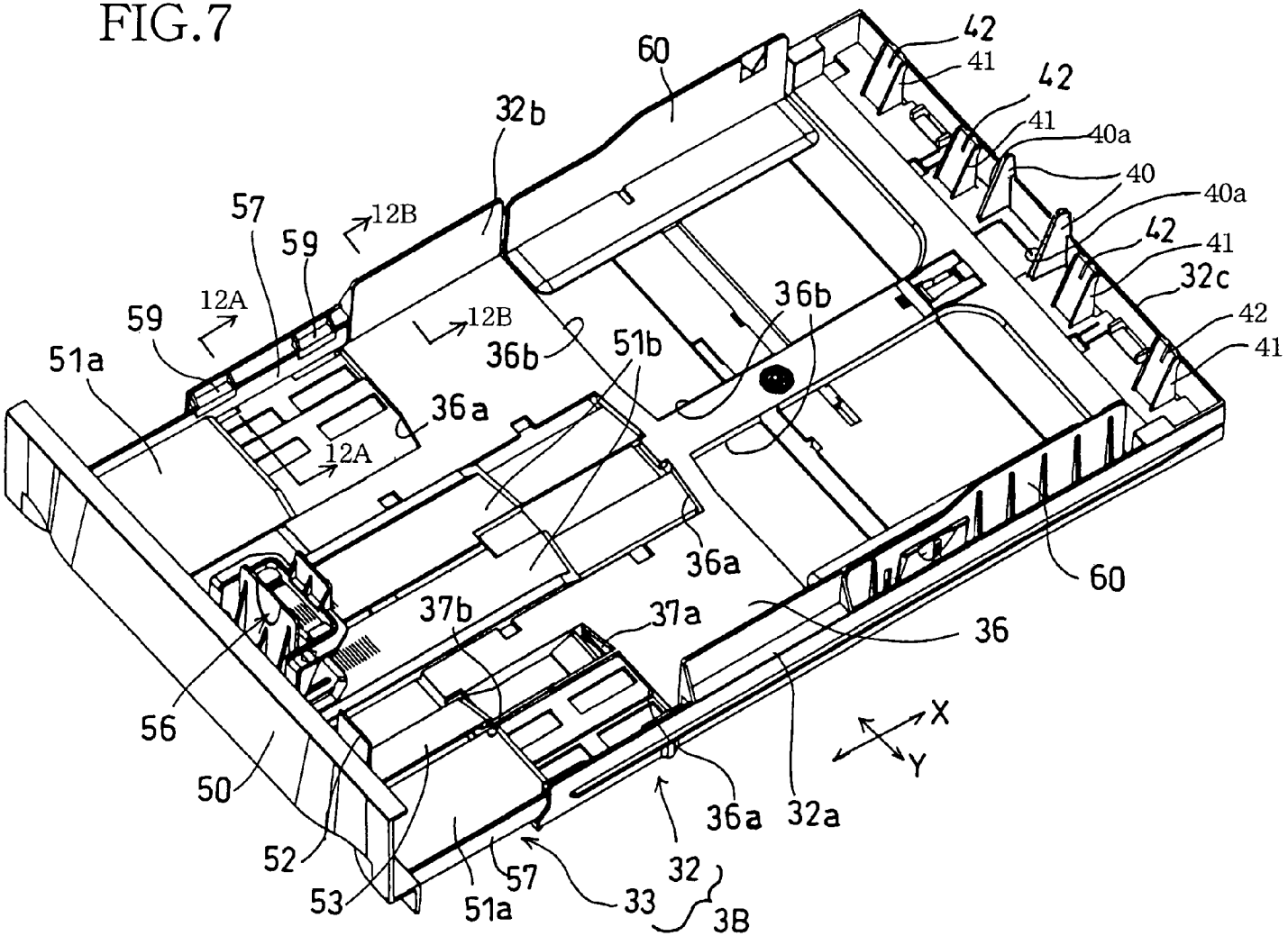
FIG. 7 is a perspective view of the lower sheet-supply cassette in a state in which the overall length of the cassette is increased.
Figure 9:
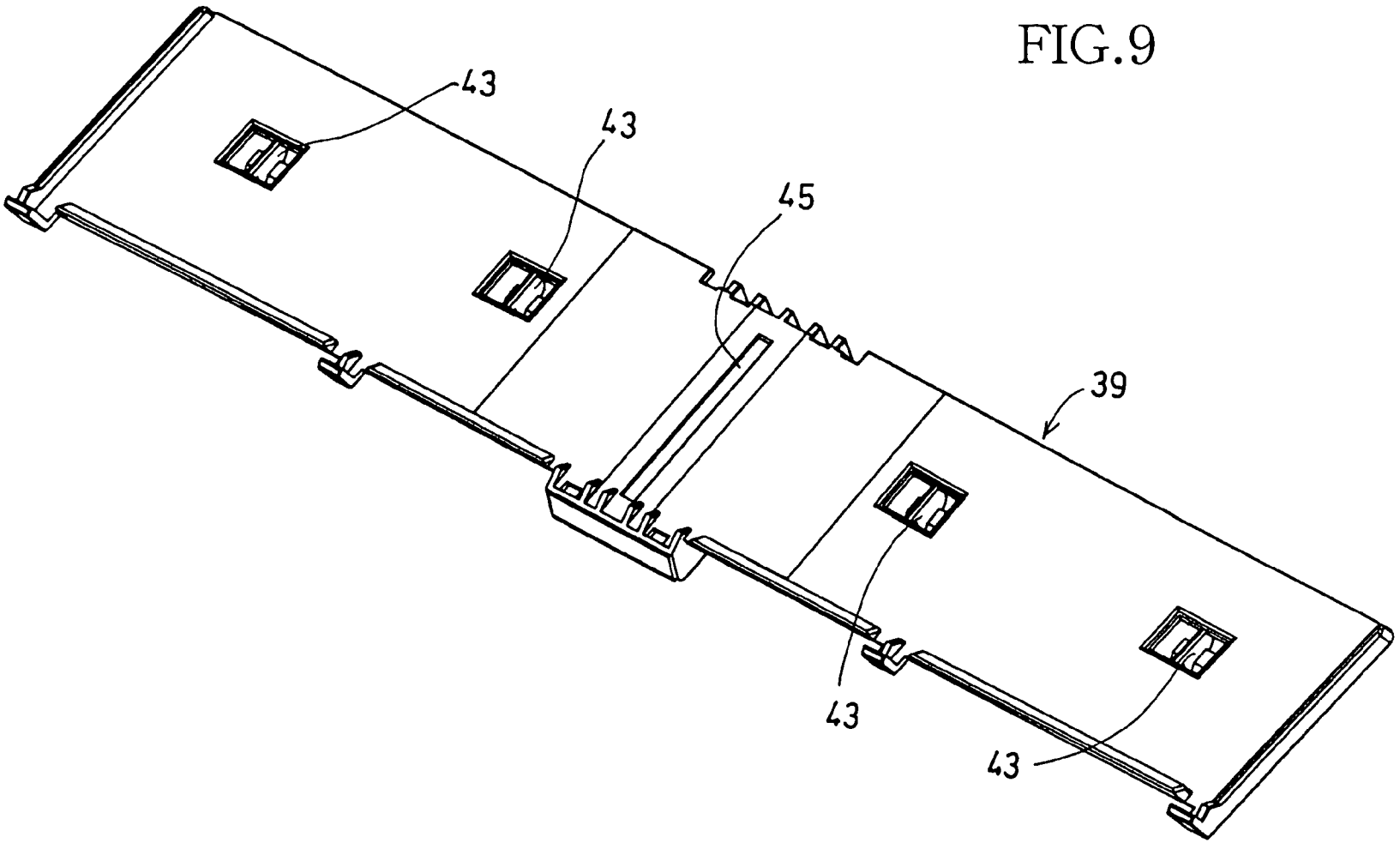
FIG. 9 is a perspective view showing a front surface of an inclined sheet-separate plate for use with the lower sheet-supply cassette.
Figure 10:
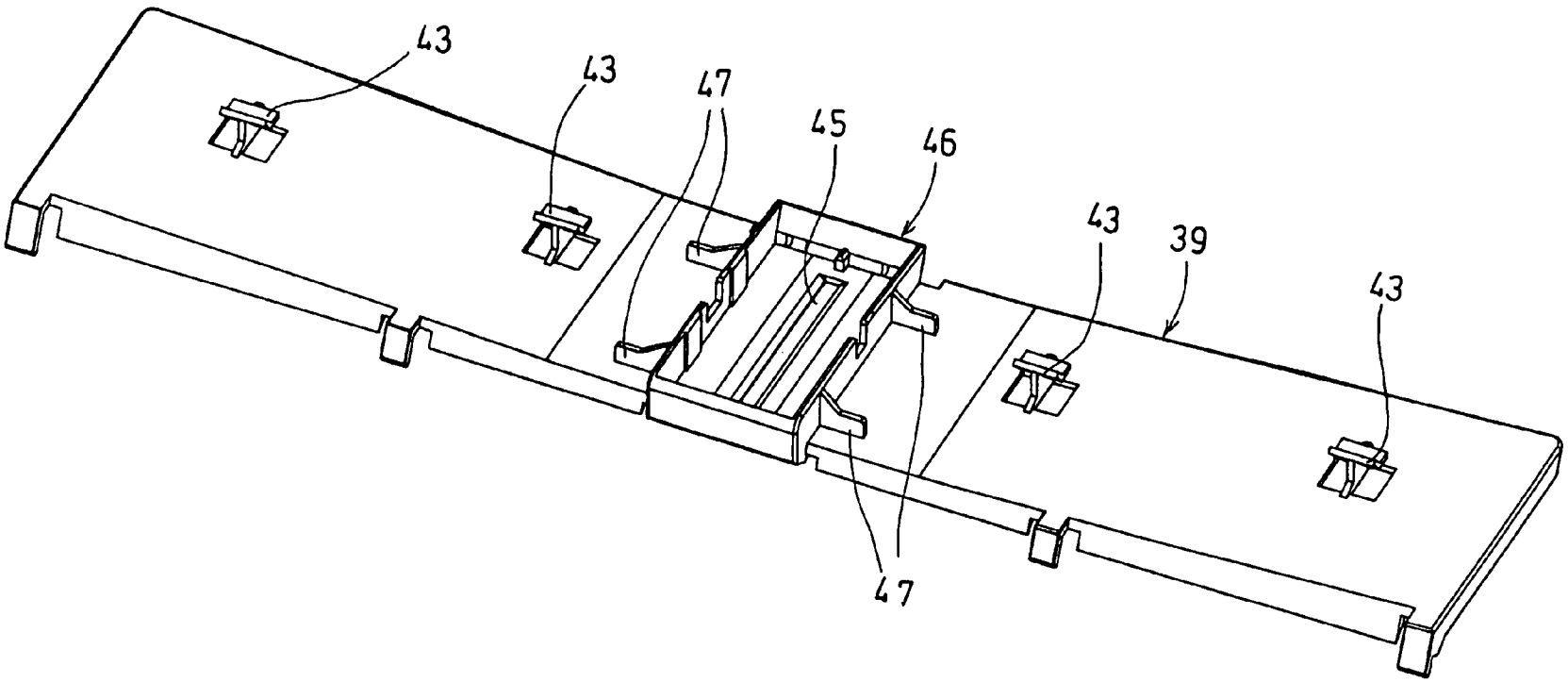
FIG. 10 is a perspective view showing a back surface of the inclined sheet-separate plate.

An inclined sheet-separate plate 39, shown in FIGS. 9 and 10, that is constituted by a single plate is supported, at a back surface thereof, by a plurality of first back-surface support portions 40 each having a trapezoidal shape in its side view, and a plurality of second back-surface support portions 41. The first and second back-surface support portions 40, 41 are provided in front of the rear wall 32*c* of the main portion 32, such that the support portions 40, 41 are distant from each other by respective appropriate distances in the Y-axis direction. As shown in FIG. 7, the second back-surface support portions 41 are located nearer to opposite ends of the rear wall 32*c* in the widthwise direction of each cut sheet P than the first back-surface support portions 40. Each of the second support portions 41 has an engaging groove 42 that extends from an upper end thereof in a downward direction. The two first back-surface support portions 40 are located nearer to a middle portion of the rear wall 32*c* in the widthwise direction of each cut sheet P, and are each constituted by a rib having a substantially triangular shape in its side view. The first back-surface support portions 40 have respective inclined surfaces 40*a* that engage and support a plurality of reinforcing ribs 47 (FIG. 10) of the inclined sheet-separate plate 39.

In the present embodiment, the two first back-surface support portions 40 are located at respective positions that are symmetrical with each other with respect to a centerline of the main portion 32 that is parallel to the sheet-feed direction, i.e., is perpendicular to a widthwise direction of the main portion 32 and that are nearer, in the widthwise direction, to the centerline than the respective positions where the four second back-surface support portions 41 are located and which are also symmetrical with each other with respect to the centerline.

The inclined sheet-separate plate 39 is formed by injection molding of a synthetic resin. The inclined plate 39 has, in the back surface thereof, a plurality of engaging claws 43 each of which is formed integrally with the remaining portion of the inclined plate 39 and has a generally T-shaped cross section. The four engaging claws 43 can engage the respective engaging grooves 42 of the four second back-surface support portions 41, when the inclined sheet-separate plate 39 is moved, in a downward direction, toward the main portion 32 by a hand of a person. In addition, as shown in FIGS. 9 and 10, the inclined sheet-separate plate 39 has, in a middle portion thereof in a lengthwise direction thereof (i.e., the Y-axis direction or the widthwise direction of each cut sheet P), a window hole 45 through which an elongate, serrate, elastic sheet-separate pad 44 (FIG. 4) as a sheet-separate member that is provided on the back surface of the inclined plate 39 is exposed to the front surface of the same 39. Moreover, as shown in FIG. 10, the inclined sheet-separate plate 39 has, in the back surface thereof, an attachment case 46 that is formed integrally with the remaining portion of the inclined plate 39 and accommodates a support member supporting the elastic pad 44. Each of the reinforcing ribs 47 is partly formed on an outer surface of a corresponding one of the side walls of the attachment case 46, and is partly formed on the back surface of the inclined plate 39. As described above, the reinforcing ribs 47 can engage the respective inclined surfaces 40*a* of the first back-surface support portions 40.

Figure 11:
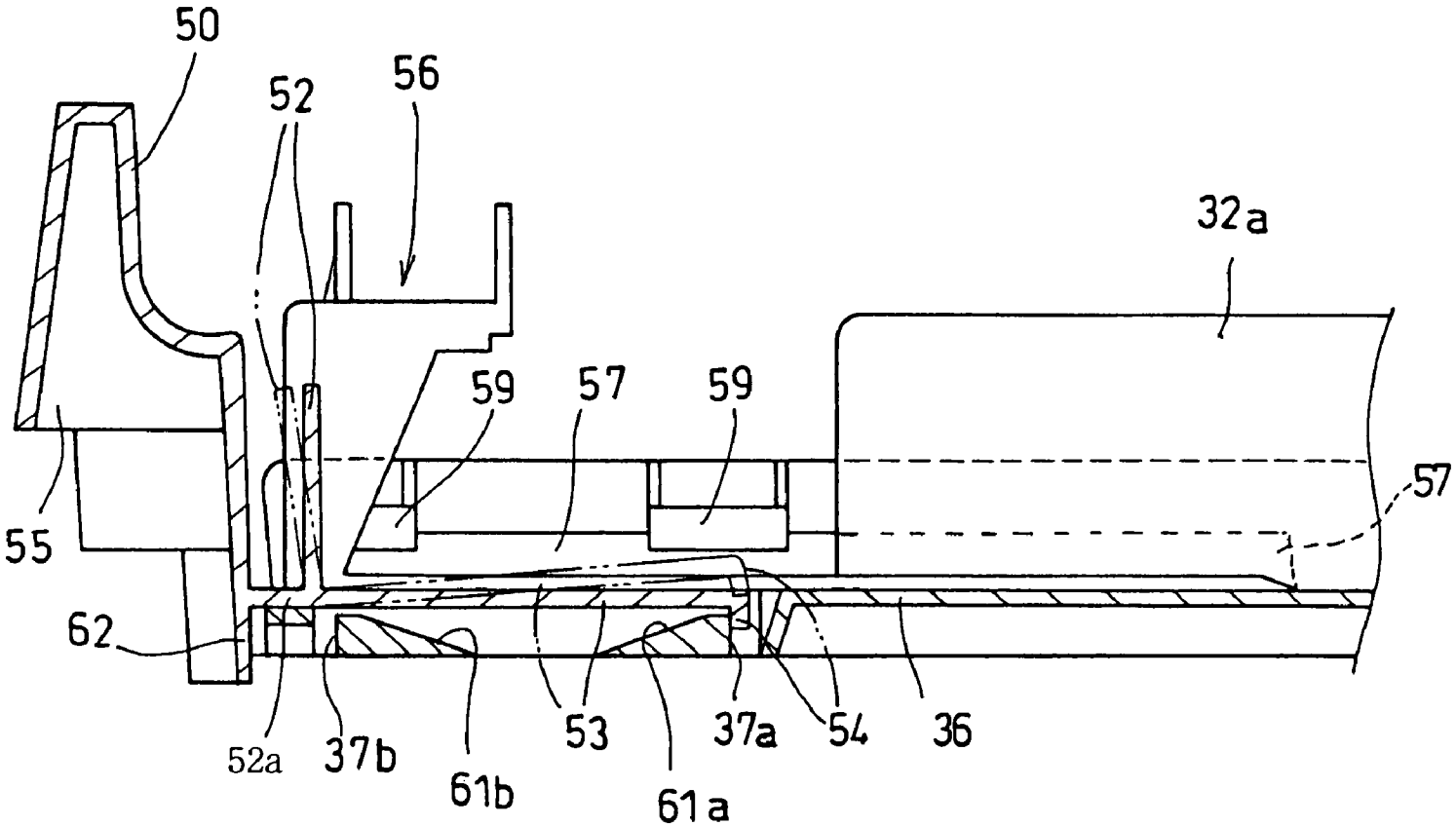
FIG. 11 is an enlarged, cross-section view taken along 11-11 in FIG. 6.

As shown in FIGS. 2, 6, 7, and 11, the auxiliary portion 33 includes a front wall 50 that can close the opening 21*a* of the front wall of the second lower case 21; two side support plates 51*a* that extend horizontally from a lower portion of the front wall 50 and cooperate with each other to support the respective rear end portions of the cut sheets P; a middle support plate 51*b* that is located between the two side support plates 51*a*, extend horizontally from the lower portion of the front wall 50, and cooperate with the two side support plates 51*a* to support the respective rear end portions of the cut sheets P; a plate-like operable portion 52 that stands upright so as to be opposed to an inner surface of the front wall 60; and a support plate 53 that extends from a lower end of the operable portion 62, in the sheet-feed direction. As shown in FIG. 11, the support plate 53 has, in a free end portion thereof, an engaging claw 54 as a second engaging portion that extends downward; and the front wall 50 has, on an outer side thereof, a handle portion 55 opening downward. Respective base portions of the operable portion 2 and the support plate 53 are integrally formed with an elastically deformable connection portion 52*a* that integrally protrudes from the lower portion of the front wall 50 and is elastically deformable upward and downward. Thus, in the auxiliary portion 33, the front wall 60 is integrally formed with the operable portion 52 and the support plate 53 including the engaging claw 54 that can selectively engage an appropriate one of the engaging grooves (i.e., the first engaging portions) 37*a*, 37*b* that are formed in the main portion 32 such that the grooves 37*a*, 37*b* are distant from each other by an appropriate distance in the sheet-feed direction.

The two side support plates 51*a*, the middle support plate 51*b*, and the support plate 53 of the auxiliary portion 33 are accommodated by the front low stepped portions 36*a* of the bottom plate 36 of the main portion 32, such that respective upper surfaces of the plates 51*b*, 51*b*, 53 are flush with an upper surface of the bottom plate 36. Therefore, the lowermost one of the cut sheets P stacked in the lower sheet-supply cassette 3B is supported by a flat surface defined by the respective upper surfaces of the plates 51*b*, 51*b*, 53, 36.

Figure 12A:
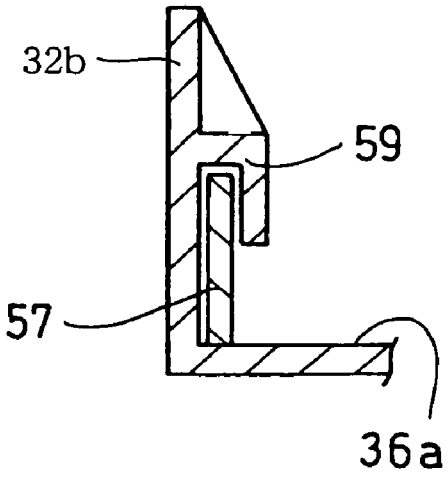
FIG. 12A is an enlarged cross-section view taken along 12A-12A in FIG. 7.
Figure 12B:
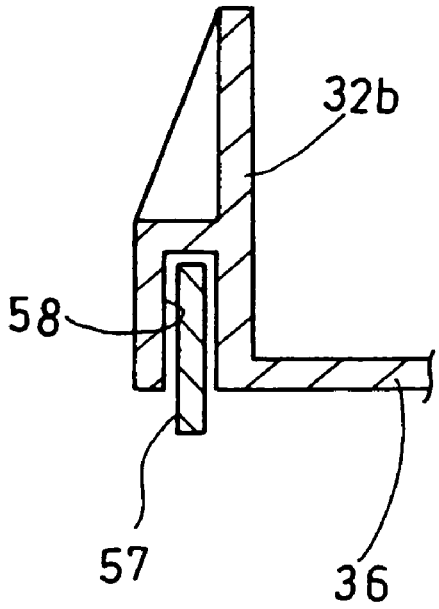
FIG. 12B is an enlarged cross-section view taken along 12B-12B in FIG. 7.
Figure 13:
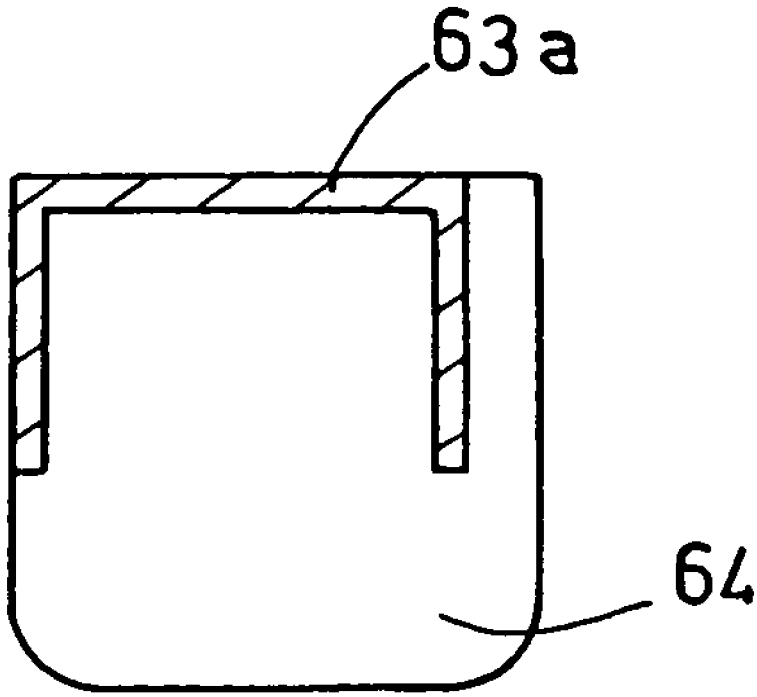
FIG. 13 is a cross-section view taken along 13-13 in FIG. 4.

The auxiliary portion 33 additionally has two guided plates 57 that are located outside the two side support plates 51*a*, respectively, are formed integrally with the same 51*a*, respectively, are short in height, and extend in the sheet-feed direction. Thus, the auxiliary portion 33 has an increased rigidity. As shown in FIGS. 12A and 12B, the two guided plates 57 are slidably insertable into two guide grooves 58, respectively, which are formed in the two side walls 32*a*, 32*b* of the main portion 32, respectively, and each of which opens downward and frontward. Each of the two side walls 32*a*, 32*b* has, on an inner surface thereof, a plurality of hold-down portions 59 that engage an upper surface of a corresponding one of the two guided plates 57. Therefore, even if the auxiliary portion 33 is largely drawn or extended from the main portion 32, as shown in FIG. 7, the front wall 50 can be effectively prevented from being tilted downward In other words, the auxiliary portion 33 can be linearly extended from, and retracted into, the main portion 32, with high stability, and, even in the state in which the auxiliary portion 33 is extended from the main portion 32, the two portions 33 are securely connected to each other, such that the respective upper surfaces of the two side support plates 51*a*, the middle support plate 51*b*, and the support plate 53 are kept flush with the upper surface of the bottom plate 36 of the main portion 32. FIGS. 12A and 12B show only the guide groove 58 and the hold-down portions 59 formed in the left-hand side wall 32*b* as seen in FIG. 7.

A sheet-rear-end guide member 56 as a positioning member that engages the respective rear ends of the cut sheets P and thereby positions the same P in the sheet-feed direction, is attached to an upper surface of the middle support plate 51*b* of the auxiliary portion 33, such that the guide member 56 is slidable in the sheet-feed direction with the user's hand while the hand feels clicks. The bottom plate 36 of the main portion 32 additionally has two rear low stepped portions 36*b* that accommodate two sheet-side-end guide members 60, respectively, that guide two widthwise opposite sides of each of the cut sheets P, respectively, and cooperate with each other to position the each cut sheet P symmetrically with respect to the centerline of the main portion 32, in the widthwise direction of the each cut sheet P. To this end, the two guide members 60 are slidable in the widthwise direction of the main portion 32.

The lower sheet-supply cassette 3B constructed as described above can be easily used in the following manner: For example, when the A4-size cut sheets P are stacked and stored in the lower cassette 3B such that the lengthwise direction of the cut sheets P is parallel to the sheet-feed direction, first, the thumb of the user's hand is applied to the outer surface of the front wall 50, and the index and middle fingers are applied to the plate-like operable portion 52, and then an external force is so applied as to decrease the distance between the inner surface of the front wall 50 and the upper portion of the operable portion 52. Consequently the connection portion 52*a* that integrally protrudes from the lower portion of the front wall 50 and is elastically deformable upward and downward is elastically deformed upward, so that the free end portion of the support plate 53 is moved upward, as indicated at two-dot chain line in FIG. 11. Thus, the engaging claw 54 is disengaged from one engaging groove 37*b* located on the upstream side of the other engaging groove 37*a* as seen in the sheet-feed direction. In this state, the auxiliary portion 33 is pushed into the front end portion of the main portion 32. Then, the external force being applied to the operable portion 52 is released. Once the engaging claw 54 is engaged with the other engaging groove 37*a* located on the downstream side in the sheet-feed direction, the lower cassette 3B is kept in the state in which the overall length thereof in the sheet-feed direction is decreased.

On the other hand, when the legal-size cut sheets P longer than the A4-size cut sheets P are stored in the lower cassette 3B, the auxiliary portion 33 is operated in reverse. More specifically described, first, an external force is applied to the operable portion 52, so as to disengage the engaging claw 54 provided in the free end portion of the support plate 53, from the downstream engaging groove 37*a*. In this state, the auxiliary portion 33 is drawn from the front end portion of the main portion 32, so that the engaging claw 54 engages the upstream engaging groove 37*b*. Thus, the lower cassette 3B is kept in the state in which the overall length thereof is increased.

As shown in FIG. 11, the bottom plate 36 of the main portion 32 has two gentle-slope surfaces 61*a*, 61*b* that are located between the two engaging grooves 37*a*, 37*b* such that the two gentle-slope surfaces 61*a*, 61*b* are opposed to each other in the sheet-feed direction and cooperate with each other to contain an obtuse angle. Therefore, in the state in which the engaging claw 54 is disengaged from one of the two engaging grooves 37*a*, 37*b*, the auxiliary portion 33 can be drawn or pushed relative to the main portion 32, without needing the application of external force to the operable portion 52. Thus, the engaging claw 54 can be smoothly engaged with the other engaging groove 37*a*, 37*b*.

As described above, the operable portion 52 is provided at the position deviated by the appropriate distance in one direction from the widthwise middle portion of the lower sheet-supply cassette 3B. This arrangement is convenient for the user to move the auxiliary portion 33 frontward and rearward by applying, with one hand, the external force to the operable portion 52 and grasping, with the other hand, the front wall 50, i.e., the handle portion 55 thereof. In addition, the front wall 50 of the auxiliary portion 33 has, in a lower end portion thereof, a support leg portion 62 that is formed integrally with the remaining portion of the front wall 50 and supports the auxiliary portion 33 at substantially the same height as a height at which the main portion 32 is supported by the second lower case 21. This arrangement assures that when the auxiliary portion 33 is moved frontward or rearward, the respective upper surfaces of the two side support plates 51*a*, the middle support plate 51*b*, and the support plate 53 can be kept flush with the upper surface of the bottom plate 36 of the main portion 32. Thus, the cut sheets P stacked in the lower cassette 3B, i.e., supported on the respective upper surfaces of the plates 51*a*, 51*b*, 53, 36 are effectively prevented from being bent or wrinkled.

As shown in FIGS. 2, 4, 5, and 13, the second lower case 21 that accommodates the lower sheet-supply cassette 3B has a plurality of reinforcing beams 63*a*, 63*b*, 63*c* that extend in a widthwise direction of the second case 21 that is perpendicular to the sheet-feed direction, and connect between respective upper portions of widthwise opposite end portions of the lower case 21. The first beam 63*a* as the most downstream one of the three beams 63*a*, 63*b*, 63*c* as seen in the sheet-feed direction has, on a lower surface thereof, a plurality of guide ribs 64 which are formed integrally with the remaining portion of the first beam 63*a* and each of which extends in the sheet-feed direction and additionally functions as a reinforcing member. Owing to the guide ribs 64, even in the case where a large number of cut sheets P up to, e.g., about 250 sheets P are stacked in the lower cassette 3B, a sheet-feed roller 65*b* of a sheet feeding device 65 can be rotated to separate and feed the sheets P, one by one, without causing jamming of each sheet P with the beam 63*a*.

Figure 4:
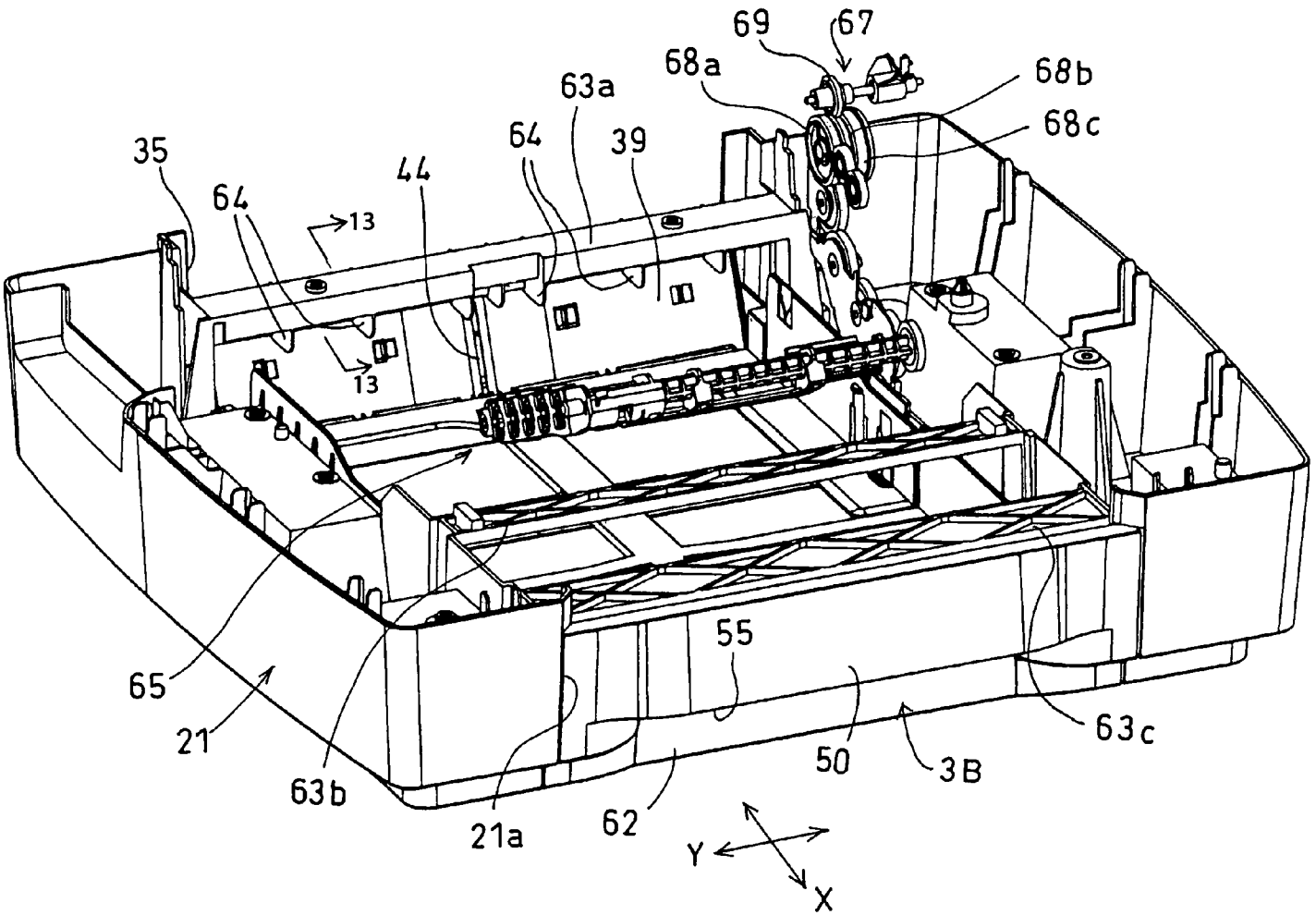
FIG. 4 is a perspective view showing a state in which a lower one of the two sheet-supply cassettes is inserted in a second lower case of the image recording apparatus.
Figure 5:
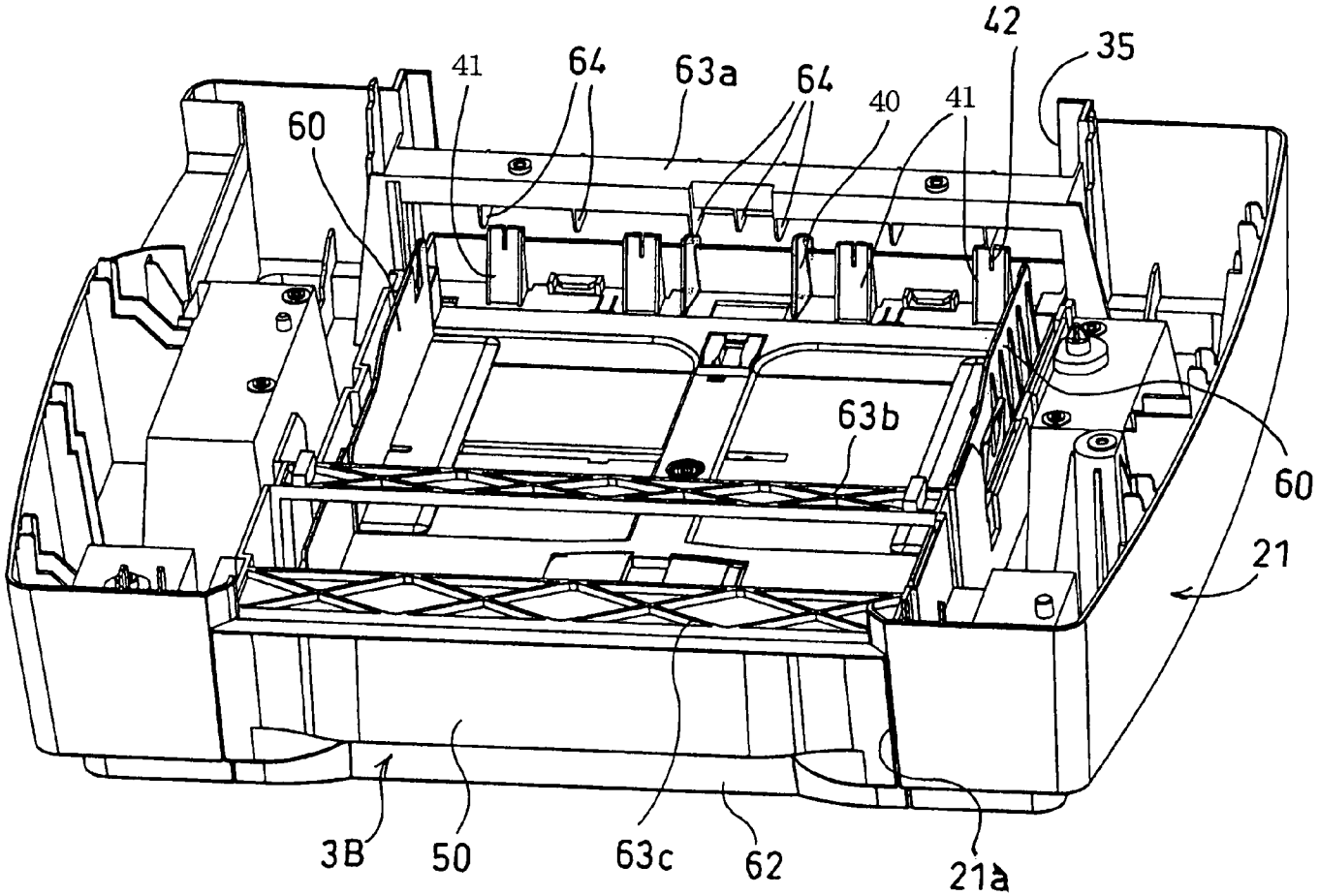
FIG. 5 is another perspective view, taken from a different angle, that shows the state in which the lower sheet-supply cassette is inserted in the second lower case.
Figure 6:
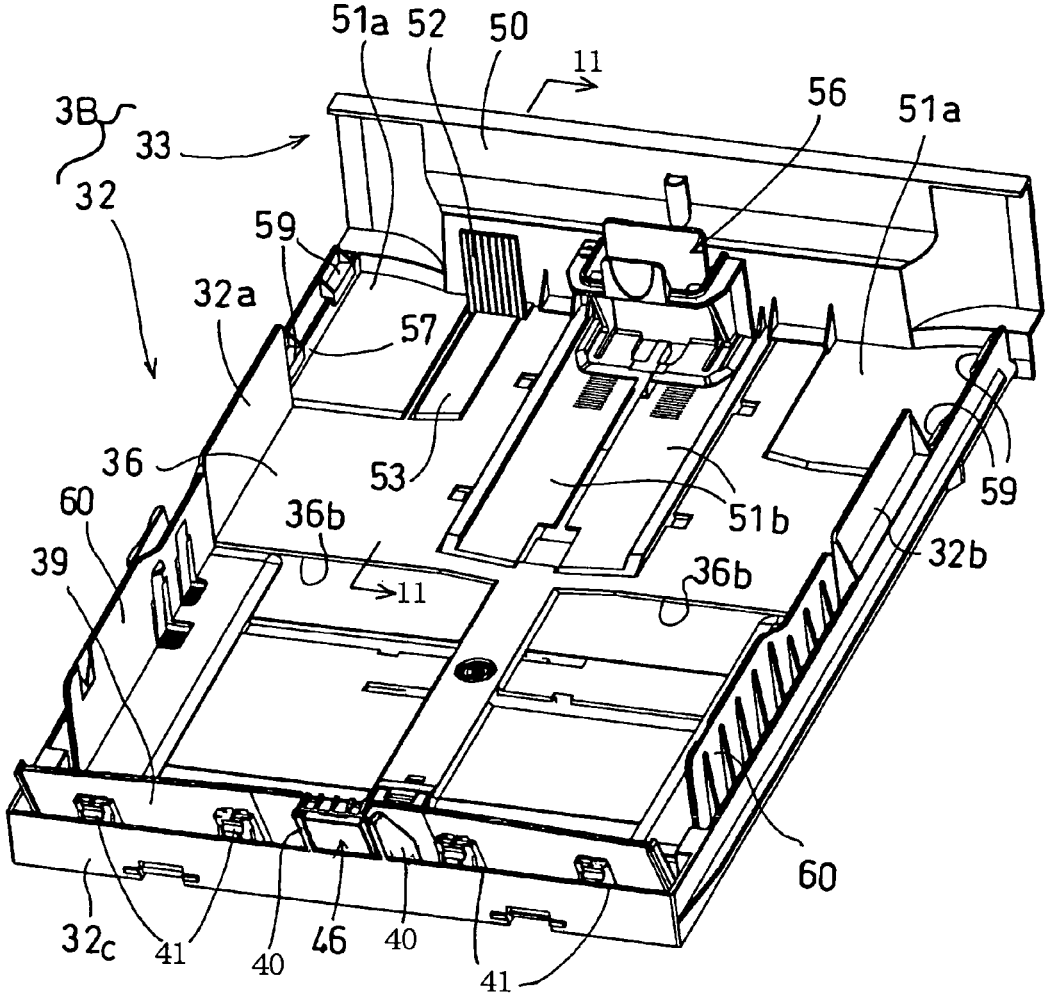
FIG. 6 is a perspective view of the lower sheet-supply cassette in a state in which an overall length of the cassette is reduced.

FIG. 4 shows a switching device 67 that selectively transmits an output power of a drive source, not shown, to either one of a first power transmission gear, not shown, for the sheet feeding device 65 of the lower sheet-supply cassette 3B, a second power transmission gear, not shown, for the sheet feeding device 6 of the upper sheet-supply cassette 3A, and a third power transmission gear for a maintenance device, not shown. The switching device 67 includes three gears 68*a*, 68*b*, 68*c* with either one of which a drive gear 69 is selectively engaged according to an amount of movement of the carriage 5 in a rightward direction in FIG. 4.

Figure 14:
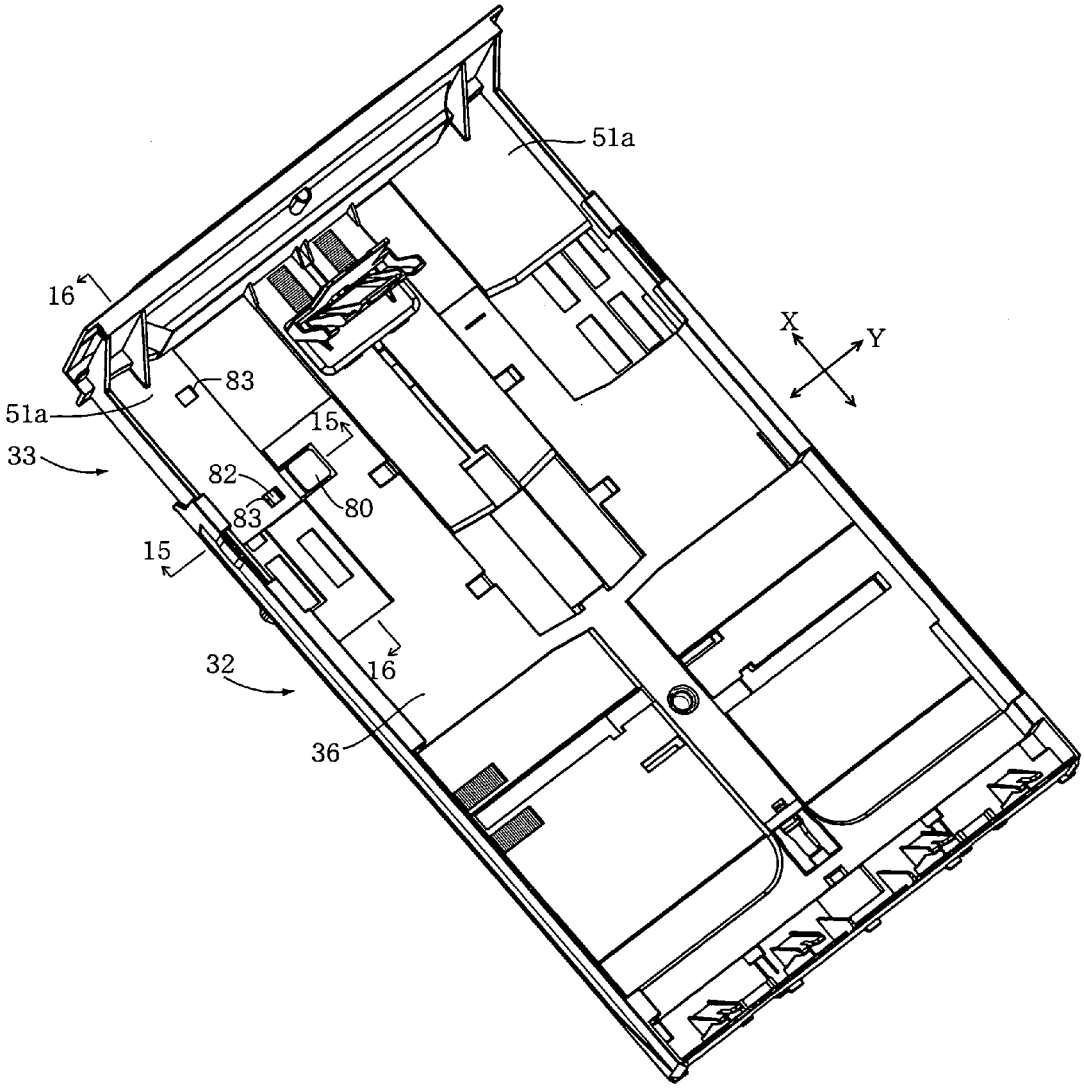
FIG. 14 is a perspective view corresponding to FIG. 7, showing another lower sheet-supply cassette as a second embodiment of the present invention.
Figure 15:
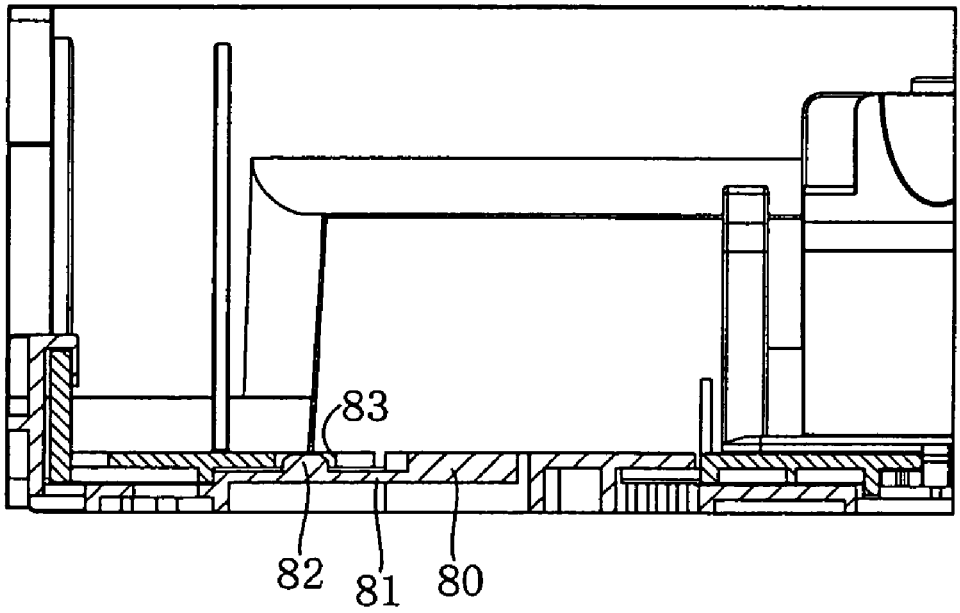
FIG. 15 is an enlarged, cross-section view taken along 15-15 in FIG. 14.
Figure 16:
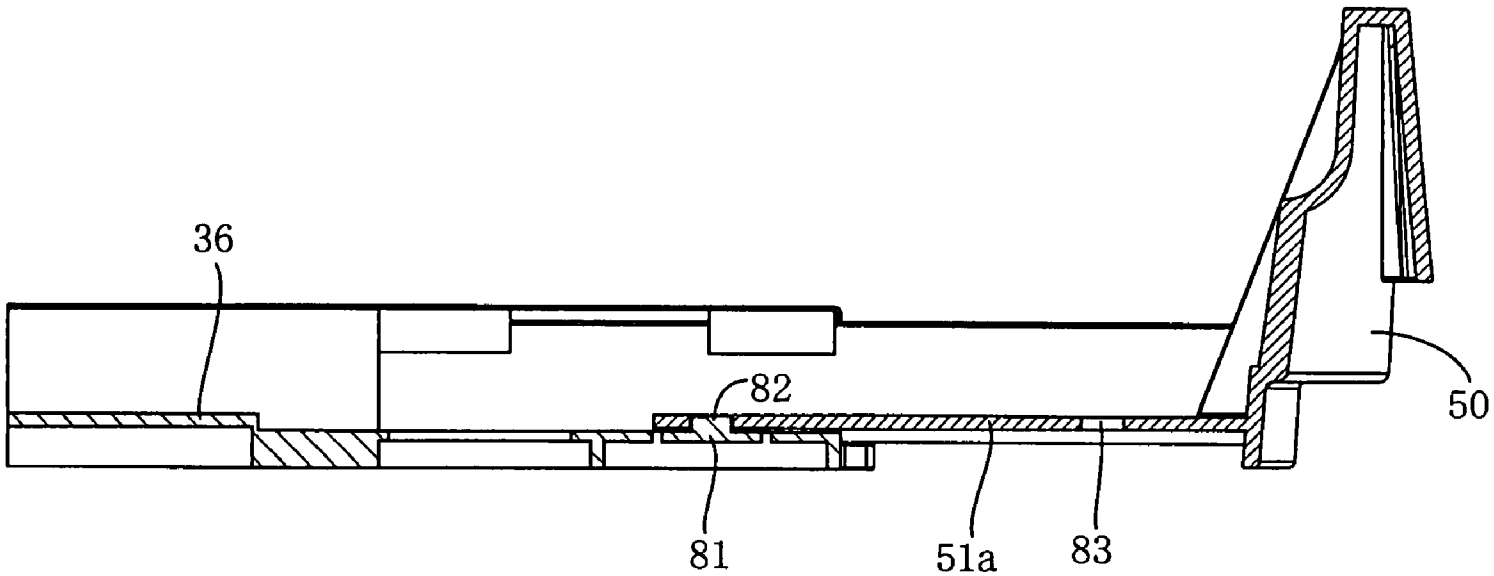
FIG. 16 is an enlarged, cross-section view taken along 16-16 in FIG. 14.

FIGS. 14, 15, and 16 show a second embodiment of the present invention. In the second embodiment, the operable portion 52, the support plate 53, the engaging claw 54, the elastically deformable base portion 52*a*, and the two engaging grooves 37*a*, 37*b* that are employed by the first embodiment shown in FIG. 11, are replaced with an operable portion 80, an elastically deformable support plate 81, and an engaging projection 82 that are supported by the main portion 32 of the second sheet-supply cassette 3B, and two engaging holes 83 that are formed in one of the two side support plates 51*a* of the auxiliary portion 33 of the second cassette 3B. The operable portion 80 and the engaging projection 82 are integrally formed, of a synthetic resin, with the support plate 81, and the support plate 81 is integrally formed, of the resin, with the bottom plate 36 of the main portion 32. The support plate 81 extends in the Y-axis direction. The engaging projection 82 has a generally rectangular shape, and opposite end portions of the projection 82 in the Y-axis direction are chamfered or tapered in the same direction. Thus, the engaging projection 82 can easily fit in each of the engaging holes 83. In addition, since the engaging projection 82 are not chamfered or tapered in the X-axis direction, the projection 82 can closely fit in each engaging hole 83, without rattling, so that the auxiliary portion 33 is stably positioned relative to the main portion 32, without rattling. Moreover, since an upper surface of the operable portion 80 is substantially flush with respective upper surfaces of the bottom plate 36 of the main portion 32 and the trailing-end-portion support plates 51*a* of the auxiliary portion 33, the cut sheets P stacked in the lower cassette 3B are effectively prevented from being bent or wrinkled. If a user pushes, with his or her finger, the operable portion 80 downward, the support plate 81 is elastically deformed downward relative to the bottom plate 36, so that the engaging projection 82 is disengaged from one of the engaging holes 83 of the side support plate 51*a*. In this state, the user can move the auxiliary portion 33 rearward or frontward in the sheet-feed direction, so that the engaging projection 82 is aligned with the other engaging hole 83. If the user moves the finger off the operable portion 80, then the engaging projection 82 is engaged with the other engaging hole 83.

While the present invention has been described in its preferred embodiments, it is to be understood that the present invention is by no means limited to the details of the described embodiments but may otherwise be embodied.

For example, in each of the above-described embodiments, the image recording apparatus 1 employs the plurality of sheet-supply cassettes 3A, 3B. However, the principle of the present invention is applicable to an image recording apparatus employing a single sheet-supply cassette only.

It is to be understood that the present invention may be embodied with various changes, modifications, and improvements that may occur to a person skilled in the art without departing from the spirit and scope of the invention defined in the appended claims.

What is claimed is:

1. A sheet-supply cassette, comprising:

a main member which is open upward and which is adapted to store a plurality of recording sheets that are stacked on each other;

an auxiliary member which is open upward and which is adapted to support respective trailing end portions of the recording sheets as seen in a sheet-feed direction in which each of the recording sheets is fed, wherein the auxiliary member is attached to the main member such that the auxiliary member is movable relative to the main member, in each of opposite directions parallel to the sheet-feed direction, so that the auxiliary member is engaged with the main member at an arbitrary one of a plurality of engagement positions;

a plurality of first engaging portions which are distant from each other in the sheet-feed direction; and an elastically deformable portion including, as an integral portion thereof, a second engaging portion, wherein elastic deformation of the elastically deformable portion causes the second engaging portion to engage an arbitrary one of the first engaging portions so as to define a corresponding one of the engagement positions, wherein the elastically deformable portion including the second engaging portion is integrally formed with one of the main member and the auxiliary member, and the first engaging portions are provided in an other of the main member and the auxiliary member, wherein the elastically deformable portion includes, as an integral portion thereof, an operable portion which is operable to elastically deform the elastically deformable portion and to engage the second engaging portion with the arbitrary one of the first engaging portions, and wherein the elastically deformable portion additionally includes a support portion supporting, as an integral portion thereof, the second engaging portion, and an elastically deformable base portion which is integral with the operable portion and the support portion, and wherein when an external force is applied to the operable portion, the elastically deformable base portion is elastically deformed so that the support portion is displaced relative to the first engaging portions and accordingly the second engaging portion is disengaged from one of the first engaging portions and, when the external force is released from the operable portion after the auxiliary member is moved relative to the main member, the elastically deformable base portion is elastically restored so that the second engaging portion is engaged with an other of the first engaging portions.

2. The sheet-supply cassette according to claim 1, wherein the main member includes a bottom plate having two inclined surfaces which are opposed to each other in the sheet-feed direction, cooperate with each other to contain an obtuse angle, and are provided between said one first engaging portion and said other first engaging portion.

3. The sheet-supply cassette according to claim 1, wherein the main member includes a bottom plate having the first engaging portions, and the auxiliary member has the elastically deformable portion including the second engaging portion.

4. The sheet-supply cassette according to claim 1, wherein the elastically deformable base portion comprises an elastically deformable base plate and, when the external force is applied to the operable portion, the elastically deformable base plate is elastically bent.

5. The sheet-supply cassette according to claim 1, wherein the auxiliary member has the elastically deformable portion including the second engaging portion, and wherein the auxiliary member further includes:

at least one trailing-end-portion support plate which supports the respective trailing end portions of the recording sheets; and a wall to which said at least one trailing-end-portion support plate is connected and which includes a handle portion formed on an outer surface of the wall, wherein the elastically deformable portion additionally includes an operable portion which stands upright so as to be opposed to an inner surface of the wall, an elastically deformable base portion from which the operable portion stands upright, and a support plate which extends from the elastically deformable base portion in the sheet-feed direction and supports, as an integral portion thereof, the second engaging portion.

6. The sheet-supply cassette according to claim 5, wherein the main member includes a bottom plate, and wherein an upper surface of the support plate is substantially flush with respective upper surfaces of the bottom plate of the main member and said at least one trailing-end-portion support plate of the auxiliary member.

7. The sheet-supply cassette according to claim 1, wherein the operable portion is provided at a position offset by a predetermined distance from a centerline of the main member that is parallel to the sheet-feed direction, in an arbitrary one of opposite directions perpendicular to the sheet-feed direction.

8. The sheet-supply cassette according to claim 1, wherein the auxiliary member further includes a position-defining member which is movable in the sheet-feed direction and which defines, in the sheet-feed direction, a position of respective edges of the respective trailing end portions of the recording sheets.

9. The sheet-supply cassette according to claim 1, wherein the auxiliary member further includes a support leg portion which is integral with the auxiliary member and which supports the auxiliary member so as to be substantially level with the main member.

10. An image recording apparatus, comprising:

the sheet-supply cassette according to claim 1;

a recording portion which records an image on said each recording sheet supplied thereto from the sheet-supply cassette; and a U-turn-path defining member which defines a U-turn path through which said each recording sheet is supplied from the sheet-supply cassette to the recording portion.

11. A sheet-supply cassette comprising:

a main member which is open upward and which is adapted to store a plurality of recording sheets that are stacked on each other;

an auxiliary member which is open upward and which is adapted to support respective trailing end portions of the recording sheets as seen in a sheet-feed direction in which each of the recording sheets is fed, wherein the auxiliary member is attached to the main member such that the auxiliary member is movable relative to the main member. iii each of opposite directions parallel to the sheet-feed direction, so that the auxiliary member is engaged with the main member at an arbitrary one of a plurality of engagement positions;

a plurality of first engaging portions which are distant from each other in the sheet-feed direction; and an elastically deformable portion including, as an integral portion thereof, a second engaging portion wherein elastic deformation of the elastically deformable portion causes the second engaging portion to engage an arbitrary one of the first engaging portions so as to define a corresponding one of the engagement positions, wherein the elastically deformable portion including the second engaging portion is integrally formed with one of the main member and the auxiliary member, and the first engaging portions are provided in an other of the main member and the auxiliary member, wherein the auxiliary member further includes:

two trailing-end-portion support plates which are provided on either side of a centerline of the main member that is parallel to the sheet-feed direction and which cooperate with each other to support the respective trailing end portions of the recording sheets; and two guided plates which are connected to the two trailing-end-portion support plates, respectively, and which extend from the two trailing-end-portion support plates, respectively, in the sheet-feed direction, and wherein the main member further includes:

a bottom plate;

two side plates which extend in the sheet-feed direction and which are connected to the bottom plate;

two hold-down members which are provided on the two side plates, respectively, and which can engage and hold down respective upper ends of the two guided plates, respectively; and two guide grooves which are formed in the two side plates, respectively, and in and from which the two guided plates can be inserted and drawn in the sheet-feed direction.

12. The sheet-supply cassette according to claim 11, wherein the auxiliary member further includes a wall to which the two trailing-end-portion support plates, and the two guided plates which respectively stand upright from the two trailing-end-portion support plates are connected.

13. A sheet-supply cassette comprising:

a main member which is open upward and which is adapted to store a plurality of recording sheets that are stacked on each other;

an auxiliary member which is open upward and which is adapted to support respective trailing end portions of the recording sheets as seen in a sheet-feed direction in which each of the recording sheets is fed, wherein the auxiliary member is attached to the main member such that the auxiliary member is movable relative to the main member in each of opposite directions parallel to the sheet-feed direction, so that the auxiliary member is engaged with the main member at an arbitrary one of a plurality of engagement positions;

a plurality of first engaging portions which are distant from each other in the sheet-feed direction; and an elastically deformable portion including, as an integral portion thereof, a second engaging portion, wherein elastic deformation of the elastically deformable portion causes the second engaging portion to engage an arbitrary one of the first engaging portions so as to define a corresponding one of the engagement positions, wherein the elastically deformable portion including the second engaging portion is integrally formed with one of the main member and the auxiliary member and the first engaging portions are provided in an other of the main member and the auxiliary member, wherein the main member has the elastically deformable portion including the second engaging portion, and additionally has a bottom plate which supports the recording sheets, wherein the elastically deformable portion additionally includes an operable portion which is operable in a downward direction relative to the bottom plate, and an elastically deformable support plate which is connected to the operable portion, extends in a direction perpendicular to the sheet-feed direction, and supports the second engaging portion, and wherein the auxiliary member has at least one trailing-end-portion support plate which supports the respective trailing end portions of the recording sheets and includes the first engaging portions.

* * * * *

UNITED STATES PATENT AND TRADEMARK OFFICE

CERTIFICATE OF CORRECTION

PATENT NO. : 7,510,181 B2
APPLICATION NO. : 11/209667
DATED : March 31, 2009
INVENTOR(S) : Daisuke Kozaki It is certified that error appears in the above-identified patent and that said Letters Patent is hereby corrected as shown below:

In Column 11, Claim 1, Line 65:
Please delete "portion includes" and insert --portion additionally includes--

In Column 13, Claim 11, Line 27:
Please delete "iii" and insert --in--

Signed and Sealed this

Fifteenth Day of September, 2009

David J. Kappos

David J. Kappos
*Director of the United States Patent and Trademark Office*